United States Patent [19]

Sato et al.

[11] Patent Number: 4,910,187

[45] Date of Patent: Mar. 20, 1990

[54] HEAT-SENSITIVE TRANSFER MATERIAL

[75] Inventors: Kozo Sato; Takeshi Nakamine; Seiiti Kubodera, all of Kanagawa, Japan

[73] Assignee: Fuji Photo Film Co., Ltd., Kanagawa, Japan

[21] Appl. No.: 239,580

[22] Filed: Sep. 1, 1988

[30] Foreign Application Priority Data

Sep. 3, 1987 [JP] Japan ..... 62-220793

[51] Int. Cl.[4] ..... B41M 5/035; B41M 5/26

[52] U.S. Cl. ..... 503/227; 8/471; 428/195; 428/336; 428/484; 428/488.1; 428/913; 428/914

[58] Field of Search ..... 8/471; 428/195, 913, 428/914, 484, 488.1, 336; 503/227

[56] References Cited

FOREIGN PATENT DOCUMENTS

| | | | |
|---|---|---|---|
| 0271063 | 6/1988 | European Pat. Off. | 503/227 |
| 0031564 | 2/1985 | Japan | 503/227 |
| 0053565 | 3/1985 | Japan | 503/227 |
| 1019396 | 1/1986 | Japan | 503/227 |
| 2050187 | 3/1987 | Japan | 503/227 |
| 1097091 | 12/1967 | United Kingdom | 503/227 |

*Primary Examiner*—Bruce H. Hess
*Attorney, Agent, or Firm*—Sughrue, Mion, Zinn, Macpeak & Seas

[57] ABSTRACT

A heat-sensitive transfer material comprising a support having provided thereon a heat-sensitive transfer layer, wherein said layer contains a dye represented by formula (I):

(I)

wherein $R_1$ and $R_2$, which may be the same or different, each represents a hydrogen atom, a-halogen atom, an alkyl group, a cycloalkyl group, an alkoxy group, an aryl group, aryloxy group, an aralkyl group, a cyano group, an acylamino group, a sulfonylamino group, a ureido group, an alkylthio group, an arylthio group, an alkoxycarbonyl group, carbamoyl group, a sulfamoyl group, a sulfonyl group, an acyl group, or an amino group;

$R_3$ and $R_4$, which may be the same or different, each represents an alkyl group, a cycloalkyl group, an aralkyl group, or an aryl group;

provided that either $R_3$ and $R_4$, $R_2$ and $R_3$, or $R_2$ and $R_4$, may combine to each other and the adjacent atoms to form a ring;

n represents an integer of from 0 to 3;

X, Y and Z, which may be the same or different, each represents a group or a nitrogen atom, wherein $R_5$ represents a hydrogen atom, an alkyl group, a cycloalkyl group, an aralkyl group, an aryl group, an alkoxy group, an aryloxy group, or an amino group;

when X and Y or X and Z each represents they may be combine with each other to form a saturated or unsaturated carbon ring; and provided that the aforesaid group comprising $R_1$, $R_2$, $R_3$, $R_4$ and $R_5$ each maybe substituted.

14 Claim, 1 Drawing Sheet

HEAT-SENSITIVE TRANSFER MATERIAL

FIELD OF THE INVENTION

This invention relates to a heat-sensitive transfer material, and more particularly to a heat-sensitive transfer material containing a dye giving excellent spectral characteristics.

BACKGROUND OF THE INVENTION

As techniques for color hard copy, a heat-sensitive transfer method, an electrophotographic method, an ink jet recording method, etc., have been vigorously investigated. A heat-sensitive transfer method is advantageous in various ways as compared to other systems because the maintenance and operation of the apparatus are easy and the apparatus and expendable supplies are inexpensive.

Examples of heat-sensitive transfer system include a system of heating a heat-sensitive transfer material having a heat-fusible ink layer on a base film by a thermal head to fuse the ink and transferring the ink onto an ink-receiving sheet as records, and a system of heating a heat-sensitive transfer material having a coloring material layer containing a sublimable dye on a base film by a thermal head to sublime the dye and transfer the dye onto a dye-receiving sheet. Between these systems, the latter sublimation transfer system is particularly advantageous for full color recording of high image quality since in the system, by changing the energy being applied to a thermal heat, the transferring amount of dyes can be changed, which allows for gradation recording.

However, there are various restrictions on sublimable dyes used in the system and there are few dyes which possess all the required properties.

The dye for the sublimation transfer system is required for have, for example, such properties that the dye has preferred spectral characteristics for color reproduction, is sublimable, a high fastness to light and heat, a high strength to various chemicals, can be easily synthesized, and which allows for a heat-sensitive transfer material containing the dye(s) to be easily prepared. Due to the recent requirement of the increase of image quality, the development of sublimable dyes having excellent spectral characteristics has been desired.

In general, a full color is formed by the combination of three colors of yellow, magenta, and cyan dyes. Among them, a magenta dye is in a position between yellow and cyan and hence the requirement for spectral characteristics on the magenta dye is most critical. Thus, the development of sublimable magenta dyes having excellent spectral characteristics has been desired.

Various kinds of magenta dyes for heat-transfer recording have been proposed. For example, there are anthraquinone series magenta dyes disclosed in JP-A-60-131293, 60-159091, 61-227093, 61-262190, etc., (the term "JP-A" as used herein means an "unexamined published Japanese patent application) and azo series magenta dyes disclosed in JP-A-60-30391, 60-30392, 60-30394, 61-227091, 61-227092, etc.

However, the spectral characteristics of these magenta dyes are far from ideal and the absorption range thereof is broad and has a considerably large side absorption.

SUMMARY OF THE INVENTION

An object of this invention is to provide a heat-sensitive transfer material containing a magenta dye having excellent spectral characteristics.

Another object of this invention is to provide a heat-sensitive transfer material containing a sublimable magenta dye which can be easily incorporated in the heat-sensitive transfer material.

Other objects and effects of this invention will be apparent from the following description.

As the result of various investigations, it has been discovered that the aforesaid objects of this invention can be attained by a heat-sensitive transfer material comprising a support having provided thereon a heat-sensitive transfer layer containing a dye represented by formula (I)

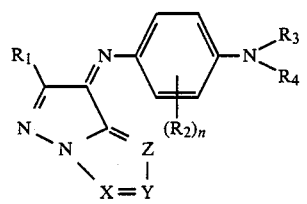

(I)

wherein $R_1$ and $R_2$ (which can be the same or different) each represents a hydrogen atom, a halogen atom, an alkyl group, a cycloalkyl group, an alkoxy group, an aryl group, an aryloxy group, an aralkyl group, a cyano group, an acylamino group, a sulfonylamino group, a ureido group, an alkylthio group, an arylthio group, an alkoxycarbonyl group, a carbamoyl group, a sulfamoyl group, a sulfonyl group, an aryl group, or an amino group; $R_3$ and $R_4$ (which can be the same or different) each represents an alkyl group, a cycloalkyl group, an aralkyl group or an aryl group; or either $R_3$ and $R_4$, $R_2$ and $R_3$, or $R_2$ and $R_4$ may combine with each other and the adjacent atoms to form a ring; n represents an integer of from 0 to 3; and X, Y and Z each represents

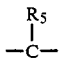

(wherein $R_5$ represents a hydrogen atom, an alkyl group, a cycloalkyl group, an aralkyl group, an aryl group, an alkoxy group, an aryloxy group, or an amino group) or a nitrogen atom; further providing that when X and Y or Y and Z are

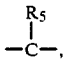

they may combine with each other to form a saturated or unsaturated carbon ring.

The aforesaid groups may be substituted by other substituents.

DETAILED DESCRIPTION OF THE INVENTION

Figure 1:
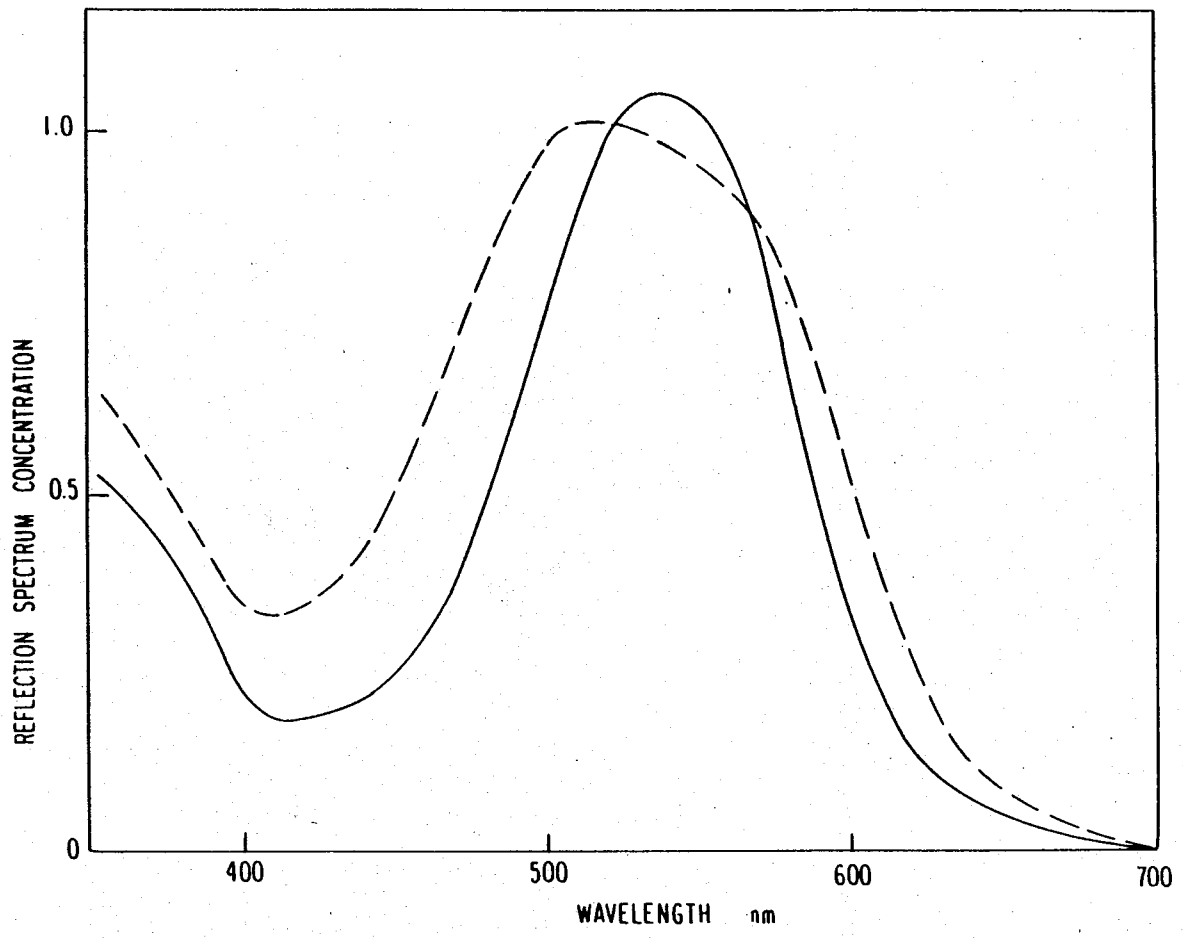
FIG. 1 is a graph showing the reflection spectra of the magenta dye in this invention and a comparison magenta dye.

The dyes shown by formula (I) described above are now explained in detail.

In formula (I), $R_1$ and $R_2$ which can be the same or different, each represents a hydrogen atom, a halogen atom (e.g., chlorine or bromine); an alkyl group (an alkyl group having from 1 to 12 carbon atoms, e.g., methyl, ethyl, butyl, isopropyl, hydroxyethyl, methoxyethyl, cyanoethyl, or trifluoromethyl); a cycloalkyl group (e.g., cyclopentyl or cyclohexyl); an alkoxy group (an alkoxy group having from 1 to 12 carbon atom, e.g., methoxy, ethoxy, isopropoxy, methoxyethoxy, or hydroxyethoxy); an aryl group (e.g., phenyl, p-tolyl, p-methoxyphenyl, p-chlorophenyl, or o-methoxyphenyl); an aryloxy group (e.g., phenoxy, p-methylphenoxy, p-methoxyphenyl, or o-methoxyphenoxy); an aralkyl group (e.g., benzyl or 2-phenetyl); a cyano group; an acylamino group (e.g., acetylamino, propionylamino, or isobutylamino); a sulfonylamino group (e.g., methanesulfonylamino, benzenesulfonylamino or trilfuoromethanesulfonylamino); a ureido group (3-methylureido, 3,3-dimethylureido, or 1,3-dimethylureido); an alkylthio group (e.g., methylthio or butylthio); an arylthio group (e.g., phenylthio or p-tolylthio); an alkoxycarbonyl group (e.g., methoxycarbonyl or ethoxycarbonyl); a carbamoyl group (e.g., methylcarbamoyl or dimethylcarbamoyl); a sulfamoyl group (e.g., dimethylsulfamoyl or diethylsulfamoyl); a sulfonyl group (e.g., methanesulfonyl, butanesulfonyl, or phenylsulfonyl); an acyl group (e.g., acetyl or butyroyl); or an amino group (e.g., methylamino or dimethylamino).

In these groups represented by $R_1$ and $R_2$, an alkyl group having not more than 8 carbon atoms, an alkoxy group having not more than 8 carbon atoms, a halogen atom, and an acylamino group having not more than 7 carbon atoms are particularly preferred.

In formula (I), $R_3$ and $R_4$, which can be the same or different, each represents an alkyl group (an alkyl group having from 1 to 12 carbon atoms, e.g., methyl, ethyl, propyl, hydroxyethyl, cyanoethyl, methoxyethyl, or methanesulfonylaminoethyl); a cycloalkyl group (e.g., cyclopentyl or cyclohexyl); or an aryl group (e.g., phenyl or p-tolyl). Among these groups, a substituted or unsubstituted lower alkyl group having from 1 to 4 carbon atoms is particularly preferred.

Examples of the ring formed by the combination of either $R_3$ and $R_4$, $R_2$ and $R_3$, or $R_2$ and $R_4$ include a 5- or 6-membered ring which may contains a hetero atom.

Also, preferred examples of the ring formed by the combination of $R_3$ and $R_4$ are

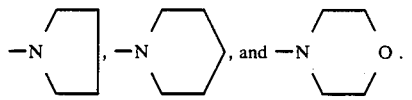

Preferred examples of the ring formed by the combination of $R_4$ or $R_3$ and $R_2$ are

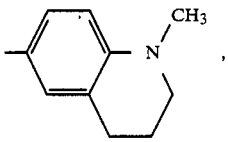

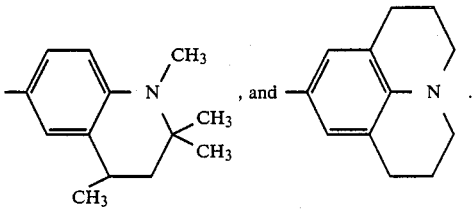

In formula (I), X, Y and Z each represents

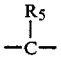

(wherein $R_5$ represents a hydrogen atom, an alkyl group, a cycloalkyl group, an aralkyl group, an aryl group, an alkoxy group, an aryloxy group or an amino group. Practical examples of the aforesaid groups are those described above in regard to $R_1$ and $R_2$, or a nitrogen atom.

In the preferred embodiments of this invention, either X, Y and Z all represent nitrogen atoms; two of X, Y, and X represent nitrogen atoms; or one of X, Y, and X represents a nitrogen atom. In the more preferred embodiment of this invention, either X, Y, and Z all represent nitrogen atoms or two of X, Y, and Z represent nitrogen atoms.

Specific examples of the dye represented dye shown by formula (I) for use in this invention are illustrated below, although the invention is not limited to them.

(1)

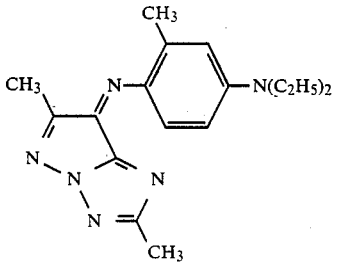

(2)

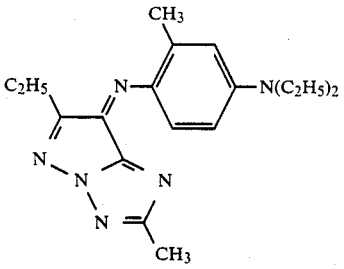

-continued
(3)
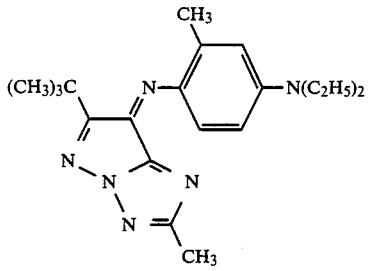
(4)
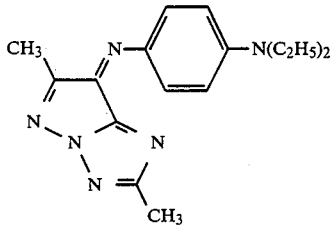
(5)
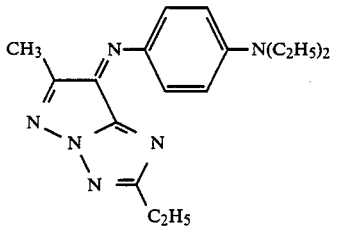
(6)
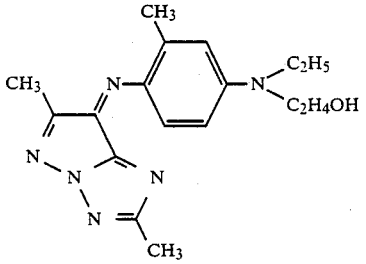
(7)
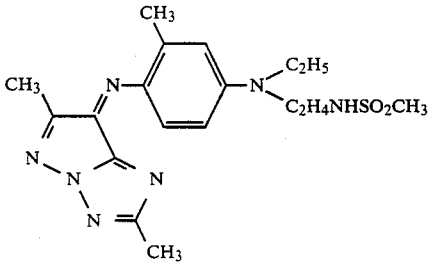
(8)
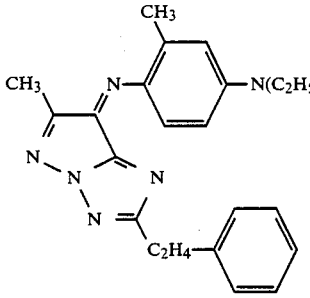
-continued
(9)
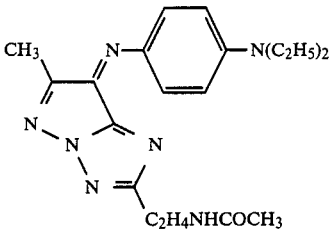
(10)
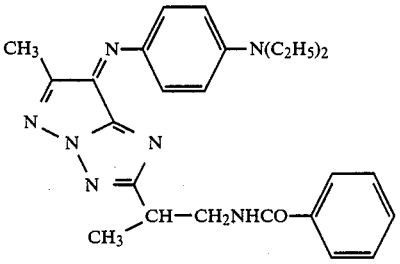
(11)
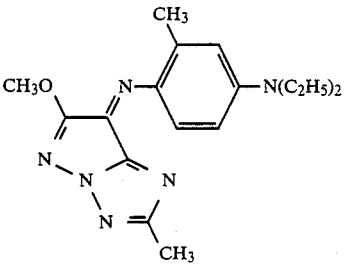
(12)
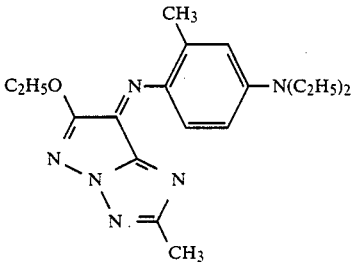
(13)
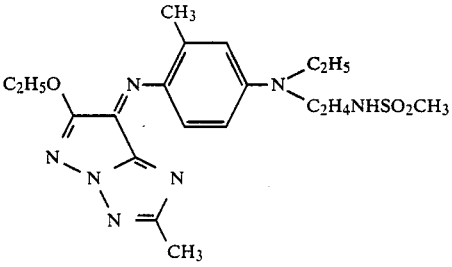
(14)
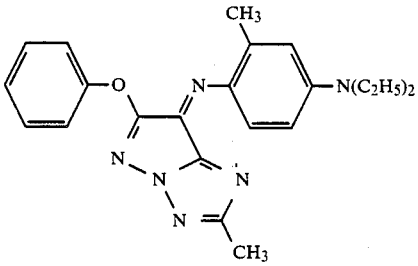

-continued
(15)
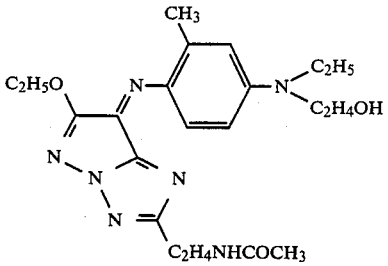
(16)
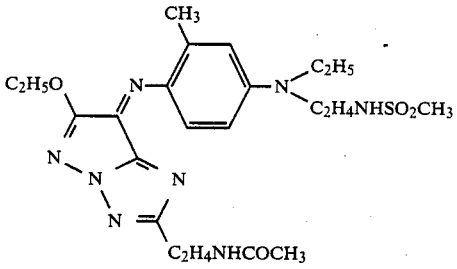
(17)
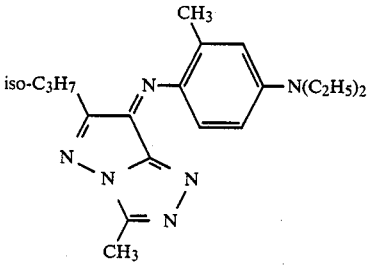
(18)
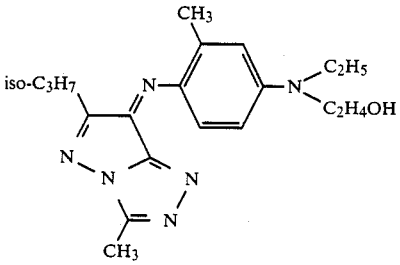
(19)
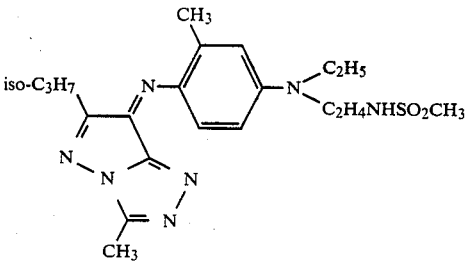
(20)
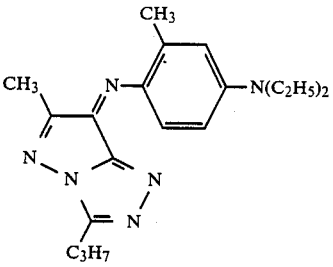
-continued
(21)
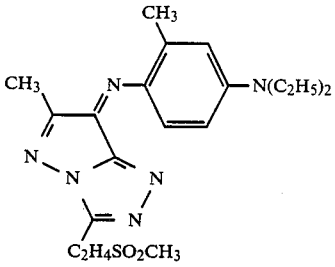
(22)
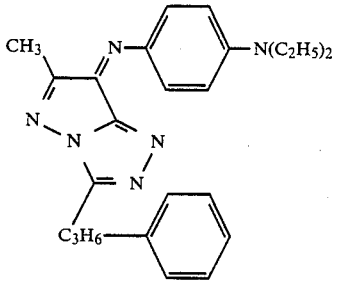
(23)
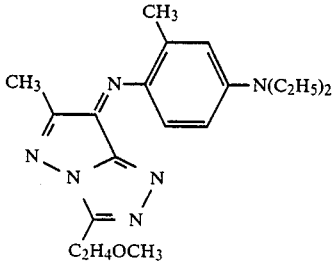
(24)
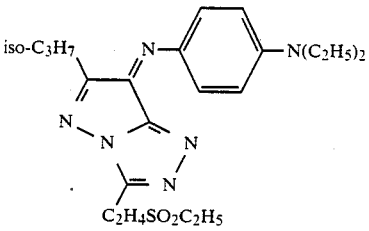
(25)
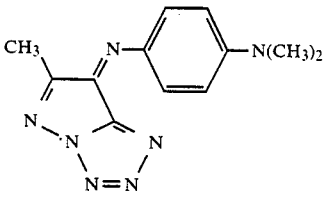
(26)
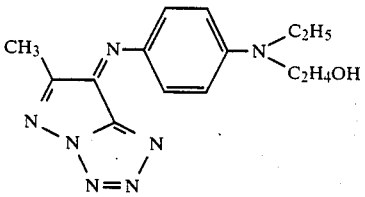

-continued (27)

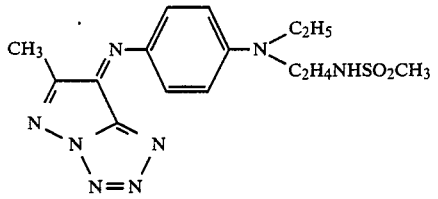

(28)

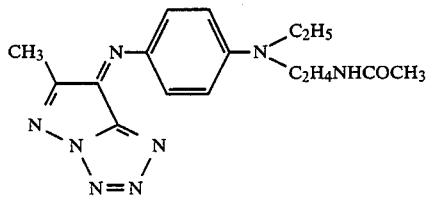

Among the above-mentioned compounds, Compounds (3), (4), (9), (14) and (25) are preferred.

Synthesis methods for dyes represented by formula (II) described above are now described.

The dye represented by formula (I) can be obtained by the oxidation coupling reaction of a fused ring pyrazole derivative represented by formula (II) and a p-phenylenediamine derivative represented by formula (III) or by the dehydrocondensation reaction of the fused ring pyrazole derivative represented by formula (II) and a nitroso compound represented by formula (IV):

Scheme 1

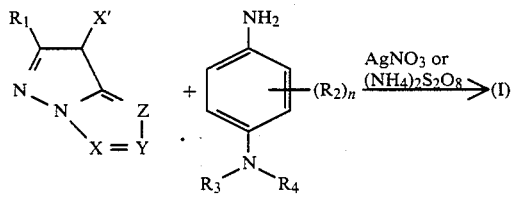

(X': H or releasable group)

Scheme 2

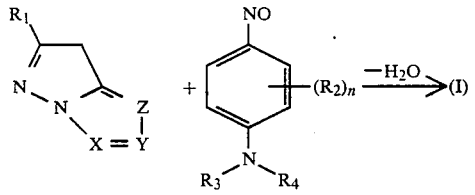

For example, a 1H pyrazolo[1,5-b][1,2,4]triazole compound represented by following formula (V)

(V)

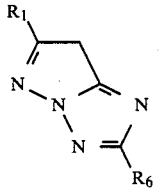

can be easily synthesized by the method described in JP-A-61-261738.

The reaction between the compound of formula (V) and the compound of formula (III) or formula (IV) also proceeds under mild conditions to provide the desired dye of formula (I) with a good yield.

A synthesis example for the dye represented by formula (I) described above is illustrated below.

SYNTHESIS EXAMPLE

Synthesis of Compound (1)

In 22 ml of ethanol were dissolved 4.3 g of a compound represented by formula (A) and then 105 ml of water and 22 g of sodium carbonate were added to the solution.

(A)

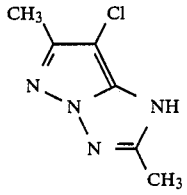

Then, 6.06 g of a compound represented by following formula (B) were added to the mixture.

(B)

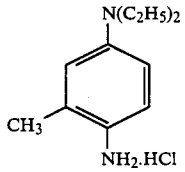

Then, an aqueous solution obtained by dissolving 8.8 g of ammonium persulfate in 60 ml of water was added dropwise to the aforesaid mixture and then the reaction was allowed to proceed for one hour. After the reaction was completed, water was added to the reaction mixture to deposit crystals, which were collected by filtration and recrystalled from isopropanol to provide 6.2 g of compound (1).

The melting point of the compound obtained was from 125° to 127° C. and $\lambda_{max}$ was 533 nm (ethyl acetate).

The main feature of the heat-sensitive transfer material of this invention is in the point of using the specific magenta dye as described above.

In a first preferred embodiment of this invention, the heat-sensitive transfer layer containing the aforesaid dye is a heat medium which is a heat-sensitive sublimation transfer layer comprising the heat-transferring dye and a binder resin. The heat-sensitive transfer material of this invention is obtained by dissolving or dispersing the dye and binder resin in a proper solvent to provide a coating composition and coating the coating composition on one surface of a support at a dry thickness of from about 0.2 μm to 5.0 μm, and preferably from about 0.4 μm to 2.0 μm followed by drying.

As the binder resin which is used with the aforesaid dye in this invention, any of binder resins which are conventionally used for the purpose can be used. In general, a binder resin which has a high heat resistance and does not hinder the transfer of the dye at heating is selected. Examples of the binder resin include polyamide series resins, polyester series resins, epoxy resins, polyurethane series resins, polyacryl series resins (e.g., polymethyl methacrylate and polyacrylamide), vinyl series resins such as polyvinylpyrrolidone, etc., polyvinyl chloride series resins (e.g., vinyl chloride-vinyl acetate copolymer), cellulose series resins (e.g., methyl cellulose, ethyl cellulose, and carboxymethyl cellulose), polyvinyl alcohol series resins (e.g., polyvinyl alcohol and partially saponified polyvinyl alcohol), acrylic acid series resins, starch series resins, petroleum series resins, rosin derivatives, coumaran-indene series resins, terpene series resins, novolak type resins, polyolefin series resins (e.g., polyurethane and polypropylene), polycarbonate, polysulfone, and polyether sulfone.

Among these binders, polyvinyl alcohol series resins (e.g., polyvinyl butyral) and cellulose series resins (e.g., ethyl cellulose) are preferred.

It is preferred that the binder resin is used in an amount of from about 80 to 600 parts by weight per 100 parts by weight of the dye.

Also, as an ink solvent for dissolving or dispersing the aforesaid dye and binder resin, one which is conventionally used for the purpose can be used. specific examples include water; alcohol series solvents such as methanol, ethanol, isopropanol, butanol, isopropanol, etc., ester series solvents such as ethyl acetate, butyl acetate, etc.; ketone series solvents such as methyl ethyl ketone, methyl isobutyl ketone, microhexanon, etc.; aromatic solvents such as toluene, xylenechlorobenzene, etc.; halogen series solvents dichloromethane, trichloroethane, chloroform, etc.; N,N-dimethylformamide, N-methylpyrrolidone, dioxane, tetrahydrofuran, and cellosolve series solvents such as methyl cellosolve, ethyl cellosolve, etc. They may be used singly or as a mixture thereof.

It is important to select a solvent which can dissolve the dye at a concentration of higher than a definite value and can sufficiently dissolve or disperse the aforesaid binder resin. For example, it is preferred to use the solvent of an amount of from about 9 to 20 times the total combined weight of the solvent and the binder resin.

As a support which is used for the construction of the heat-sensitive transfer material of this invention, conventional supports having heat resistance and strength can be used. For example, there are papers, various kinds of coated papers, polyester films, polystyrene films, polypropylene films, polysulfone films, polycarbonate films, polyphenylene sulfide films, polyvinyl alcohol films, cellophane, etc., having a thickness of generally from 0.5 μm to 50 μm, and preferably from 3 μm to 10 μm. Among these supports, a polyester film is particularly preferred.

For coating an ink (i.e., the dye-containing coating composition) on a support, a reverse roll coater, a gravure coater, a rod coater, an air doctor coater, etc., can be used.

The heat-sensitive transfer layer of the present invention may contain an ultraviolet ray absorbing agent and a color deterioration preventing agent for improving fasteness of the color image.

The heat-sensitive transfer material as described above is sufficiently used as it is but furthermore, a stick prevention layer, that is, a releasable layer may be provided on the dye-carrying (heat-sensitive transfer) layer. By forming such a layer, the adherence of the heat-sensitive transfer material to the dye-receiving material at the time of heat transfer recording can be prevented and images having superior density can be formed using a higher heat transferring temperature.

For such a releasable layer, simple attaching of a stick or adherence preventive inorganic powder onto the surface of the light-sensitive transfer material may have a considerable effect. However, a layer of from about 0.01 μm to 5 μm, and preferably from 0.05 μm to 2 μm in thickness may be formed using, for example, a silicone polymer, an acryl polymer, or a fluorinated polymer.

In addition, the aforesaid inorganic powder or the releasable polymer may be incorporated in the dye-carrying layer with a sufficient effect.

Furthermore, for preventing the adverse effects of heat on a thermal head, a heat resistant layer may be formed on the surface of the heat-sensitive transfer material of this invention.

In the present invention, a dye barrier layer (described in U.S. Pat. No. 4,700,208) and a slipping layer (described in U.S. Pat. No. 4,717,712) may be provided.

The heat-sensitive transfer material in the first preferred embodiment of this invention is superposed on a conventional dye-receiving sheet and the heat-sensitive transfer material is heated from any one of the surfaces of the assemblage, preferably from the surface of the heat-sensitive transfer material by a heating means such as a thermal head, etc., according to image signals, whereby the dye in the heat-sensitive transfer layer is transferred onto the dye-receiving layer of the dye-receiving sheet according to the extent of the heating energy to form color images having excellent sharpness and resolving power.

The dye for use in this invention can be also used in other heat-sensitive transfer materals besides the sublimation transfer material. That is, in a second preferred embodiment of this invention, a heat-sensitive transfer layer of the heat-sensitive transfer material is a heat-sensitive melt transfer layer comprising the dye of this invention and a wax. The heat-sensitive transfer material of this embodiment is obtained by preparing an ink for forming the heat-sensitive transfer layer comprising the dye and wax and forming a heat-sensitive melt transfer layer on one surface of a support as described above using the ink. The ink is prepared by dispersing the dye in a wax such as paraffin wax, microcrystalline wax, carnauba wax, urethane series wax, etc., which functions as a binder. The ratio of the dye to the wax is from about 10% by weight to 65% by weight of the total weight of the dye in the heat-sensitive melt transfer layer formed. The thickness of the layer formed is preferably in the range of from about 1.5 μm to 6.0 μm. The preparation and the application thereof on a support can be performed according to known techniques.

When the heat-sensitive transfer material of the second preferred embodiment of this invention is used, as in the case of the first embodiment, the heat-sensitive melt transfer layer is transferred onto an image-receiving sheet to give excellent color prints.

Since the dye represented by aforesaid formula (I) has clear magenta color, the dye is suitable for obtaining full color recordings having good color reproducibility by combining with a suitable cyan dye and a suitable yellow dye. Also, since the aforesaid dye is sublimable and has a high molecular extinction coefficient, records of high color density can be obtained at a high speed without applying a large load onto a thermal head. Furthermore, since the dye is stable to heat, light, moisture, chemicals, etc., the dye does not cause thermal decomposition during transfer recording and the records obtained possess excellent storage stability. Also, since the dye has good solubility in organic solvents and good dispersibility in water, an ink having a high concentration of the dye can be easily prepared by uniformly dissolving the dye in an organic solvent or uniformly dispersing the dye in water. The heat-sensitive transfer sheet having a heat-sensitive transfer layer containing the dye at a uniformly high concentration can be obtained by using the ink. Thus, by using the heat-sensitive transfer sheet, records having good uniformity and color density can be obtained.

The following examples serve to illustrate the invention without limiting, however, the scope of this invention. Unless otherwise indicated, all parts, percents, ratios, etc. are by weight.

EXAMPLE 1

| Preparation of Ink | |
|---|---|
| Dye (Compound (1)) | 4 g |
| Polyvinylbutyral Resin | 4 g |
| Toluene | 40 ml |
| Methyl Ethyl Ketone | 40 ml |
| Polyisocyanate (Takenate D110N, trade name, made by Takeda Chemical Industries, Ltd.) | 0.2 ml |

A mixture of the aforesaid components was coated on a polyethylene terephthalate film of 6 μm in thickness using a wire bar #20 and air dried to provide a heat-sensitive transfer material.

Then, an ink composition for a dye-receiving layer having the following formula was coated on a synthetic paper (YUPO-FPG 150, trade name, made by Oji Yuka K.K.) having a thickness of 150 μm at a dry coverage of 5 g/m$^2$ using a wire bar and dried to provide a dye-receiving sheet. Drying was performed as follows; that is, the coated layer was initially dried using a dryer and then dried for one hour in an oven at 100° C. to sufficiently allow for evaporation of the solvent.

| Ink Composition for Dye-Receiving Layer | |
|---|---|
| Aqueous Dispersion of 34% by weight Saturated Polyester (Byronal MD-1200, trade name, made by Toyobo Co., Ltd.) | 10 g |
| Silica (Nipeil E220A, trade name, made by Nippon Silica Kogyo K.K.) | 1 g |

The heat-sensitive transfer material prepared above was superposed on the dye-receiving sheet thus obtained with the dye-containing layer and the dye-receiving layer in a face-to-face relationship. Recording was applied from the support side of the heat-sensitive transfer material by a thermal head under the conditions of 1 W/1 dot in the output of the thermal heat, 0.3 to 6 msec. in pulse width and 6 dots/mm in dot density, whereby clear magenta color images could be obtained. Thus, records having gradation according to the applied energies, i.e., having a reflection density of 1.65 at the high density colored portions having a pulse width of 6 msec and a reflection density of 0.15 at a colored portion having a pulse width of 0.3 msec. For the measurement of the density, Macbeth Densitometer RD-519 was used.

EXAMPLES 2 TO 10

By following the same procedure as in Example 1 except that dyes and binders shown in Table 1 below were used in place of the dye and the binder used in Example 1, heat-sensitive transfer materials were prepared. By performing transfer recording using the each of the heat-sensitive transfer materials and the dye-receiving sheet as in Example 1, clear magenta records having densities shown in Table 1 below were obtained.

TABLE 1

| Example No. | Dye | Binder | Color Density (high density portion) |
|---|---|---|---|
| 2 | Compd. (4) | Polyvinylbutyral 5000A | 1.60 |
| 3 | Compd. (6) | Polyvinylbutyral 5000A | 1.65 |
| 4 | Compd. (9) | Polyvinylbutyral 5000A | 1.60 |
| 5 | Compd. (10) | Polyvinylbutyral 5000A | 1.65 |
| 6 | Compd. (1) | Ethyl Cellulose | 1.75 |
| 7 | Compd. (12) | " | 1.70 |
| 8 | Compd. (35) | " | 1.55 |
| 9 | Compd. (4) | Polysulfone* | 1.60 |
| 10 | Compd. (23) | " | 1.50 |

*Yudel P-1700, trade name, made by Nissan Chemical Industries, Ltd.

EXAMPLE 11

The reflection spectra of the magenta color images obtained in Examples 1 to 10 and the color images obtained by using either Compound (a) or (b) as a comparison dye were measured. The wavelength values ($\lambda_{max}$) giving the maximum reflection density are shown in Table 2.

Also, the reflection spectra of the transferred records obtained in Example 1 and Comparative Example (a) are shown in FIG. 1.

The reflection densities of these magenta color images were measured using Macbeth densitometer RD-519 for green filter density ($D_G$), red filter density ($D_R$), and blue filter density ($D_B$), and the results obtained are shown in Table 2.

TABLE 2

Compound (a)

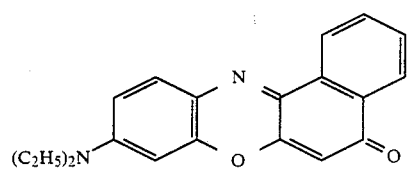

(for Comparative Example a)

Compound (b)

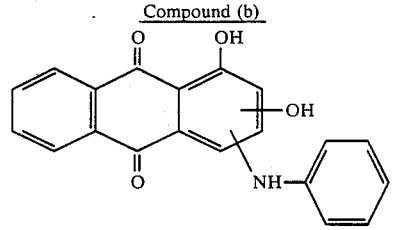

(for Comparative Example b)

| No. | $\lambda_{max}$ | $D_G$ | $D_R$ | $D_B$ |
|---|---|---|---|---|
| Example | | | | |
| 1 | 540 | 1.0 | 0.11 | 0.20 |
| 2 | 535 | 1.0 | 0.07 | 0.22 |
| 3 | 538 | 1.0 | 0.10 | 0.21 |
| 4 | 530 | 1.0 | 0.09 | 0.22 |
| 5 | 530 | 1.0 | 0.12 | 0.20 |
| 6 | 540 | 1.0 | 0.11 | 0.20 |
| 7 | 528 | 1.0 | 0.08 | 0.23 |

TABLE 2-continued

Compound (a)

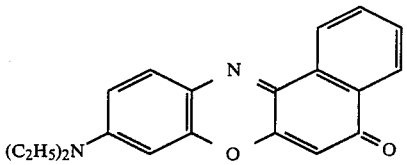

(for Comparative Example a)

Compound (b)

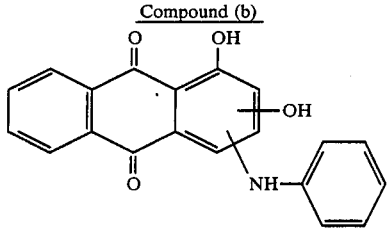

(for Comparative Example b)

| No. | $\lambda_{max}$ | $D_G$ | $D_R$ | $D_B$ |
|---|---|---|---|---|
| 8 | 530 | 1.0 | 0.09 | 0.22 |
| 9 | 535 | 1.0 | 0.07 | 0.22 |
| 10 | 539 | 1.0 | 0.11 | 0.20 |
| Comparative Example a | 510 | 1.0 | 0.15 | 0.36 |
| Comparative Example b | 515 | 1.0 | 0.14 | 0.41 |

It is clear from the results obtained that the use of the dyes of this invention gives full color prints having excellent color reproducing characteristics of $\lambda_{max}$ in the domain of from 530 nm to 540 nm and less $D_B$ and $D_R$ than $D_G$ as compared to the use of the comparison dyes which have been conventionally used.

Also, as is clear from FIG. 1, the reflection spectrum (solid line) of the dye in this invention has less side absorptions than the reflection spectrum (dotted line), which shows the dye of this invention being able to give superior hue to the comparison dye.

EXAMPLE 12

The following ink composition of dye-receiving layer was coated on a paper support for photographic paper, both surfaces of which had been coated with polyethylene, at a coverage of 16.5 g/m$^2$ to provide a dye-receiving sheet for heat transfer.

| Ink Composition for Dye-Receiving Layer | |
|---|---|
| Polycarbonate Resin (No. 035, made by General Science Corporation) | 15 g |
| Dibutyl Phthalate | 1.5 g |
| Methylene Chloride | 250 ml |

By following the same transfer procedure as in Example 1 using the dye-receiving sheet and each of the heat-sensitive transfer materials in Examples 1 to 10, transferred records of similar clear magenta images were obtained.

EXAMPLE 13

| Ink Composition for Melt Transfer Layer | |
|---|---|
| Dye (Compound (24)) | 10 g |
| Modified Lanolin Oil (binder) | 30 g |

-continued

| Ink Composition for Melt Transfer Layer | |
|---|---|
| Carnauba Wax (binder) | 20 g |
| Paraffin Wax (binder) | 20 g |
| Dispersant | 0.5 g |
| Liquid Paraffin | 5 g |

The aforesaid ink composition for melt transfer layer was mixed with 100 parts by weight of methyl ethyl ketone and 130 parts by weight of toluene at 68° C. and dispersed therein for about 48 hours by means of a ball mill.

Then, 300 parts by weight of a solution of 20% by weight vinyl chloride-vinyl acetate copolymer resin (10 parts of the resin, 20 parts of toluene, and 20 parts of methyl ethyl ketone) was added to the ink dispersion described above and they were dispersed for about one hour by a ball mill to provide a coating composition for a heat-sensitive transfer composition.

The coating composition was coated on the surface of a polyester film having a heat-sensitive layer composed of a silicone resin at the back side thereof using a wire bar and dried for one minute at a drying temperature of 100° C. to form a metal transfer ink layer of about 5 μm in thickness.

The heat-sensitive transfer sheet thus obtained was superposed on a synthetic paper as an image-receiving sheet so that the ink-carrying layer was in contact with the surface of the synthetic paper. Then, heat energy was applied from the back side of the heat-sensitive transfer sheet by a thermal head to perform image recording, whereby clear magenta color images were recorded.

EXAMPLE 14

The coating composition for the resistant layer having the following formula was coated on one surface of a polyethylene terephthalate film of 4 μm in thickness and dried.

| Composition for Resistant Layer | |
|---|---|
| Toluene | 25 g |
| Methyl Ethyl Ketone | 25 g |
| Methyl Isobutyl Ketone | 25 g |
| Polyester (Biron 290, trade name, made by Toyobo Co., Ltd) | 15 g |
| Carbon Black | 7 g |
| Dispersant | 3 g |

Then, each of the ink composition in Example 1 to Example 10 was coated on the back surface of the film to provide electric-type heat-sensitive transfer materials.

The heat-sensitive transfer sheet was superposed on an image-receiving paper same as in Example 1 so that the ink-coated layer was in contact with the image-receiving layer of the image-receiving paper. By electrically heating the resistant layer of the heat-sensitive transfer sheet by electrodes, transferred records were obtained. The electrodes had 6 dots/mm and printing energy was 0.8 mJ/dot. Thus, clear magenta color records were obtained on the image-receiving paper.

As is clear from the above disclosure, by using the heat-sensitive transfer material of this invention containing the dye described above, magenta color records having varying density according to the varying amount of heating energy and hence by combining the magenta dye with other dyes, clear full color prints of excellent color reproducing characteristics having intermediate gradation tone can be obtained.

While the invention has been described in detail and with reference to specific examples thereof, it will be apparent to one skilled in the art that various changes and modifications can be made therein without departing from the spirit and scope thereof.

What is claimed is:

1. A heat-sensitive transfer material comprising a support having provided thereon a heat-sensitive transfer layer, wherein said layer contains a dye represented by formula (I) and a binder:

(I)

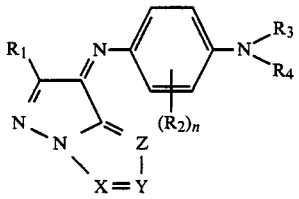

wherein $R_1$ and $R_2$, which may be the same or different, each represents a hydrogen atom, a halogen atom, an alkyl group, a cycloalkyl group, an alkoxy group, an aryl group, an aryloxy group, an aralkyl group, a cyano group, an acylamino group, a sulfonylamino group, a ureido group, an alkylthio group, an arylthio group, an alkoxycarbonyl group, a carbamoyl group, a sulfamoyl group, a sulfonyl group, an acyl group, or an amino group;

$R_3$ and $R_4$, which may be the same or different, each represents an alkyl group, a cycloalkyl groups, an aralkyl group, or an aryl group;

provided that either $R_3$ and $R_4$, $R_2$ and $R_3$, or $R_2$ and $R_4$, may combine to each other and the adjacent atoms to form a ring;

n represents an integer of form 0 to 3;

X, Y and Z, which may be the same or different, and each represents a

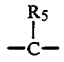

group or a nitrogen atom, wherein $R_5$ represents a hydrogen atom, an alkyl group, a cycloalkyl group, an aralkyl group, an aryl group, an alkoxy group, an aryloxy group, or an amino group;

when X and Y or X and Z each represents

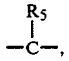

they may combined with each other to form a saturated or unsaturated carbon ring; and provided that the aforesaid groups comprising $R_1$, $R_2$, $R_3$, $R_4$ and $R_5$ each may be substituted.

2. A heat-sensitive transfer material as claimed in claim 1, wherein at least one of $R_1$ and $R_2$ represents an alkyl group having 8 or less carbon atoms, an alkoxy group having 8 or less carbon atoms, a halogen atom, or an acylamino group having 7 or less carbon atoms.

3. A heat-sensitive transfer material as claimed in claim 1, wherein at least one of $R_3$ and $R_4$ represents a lower alkyl group having from 1 to 4 carbon atoms.

4. A heat-sensitive transfer material as claimed in claim 1, wherein $R_3$ and $R_4$ together with the adjacent atom form a ring selected from the group consisting of the following formulae:

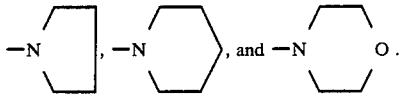

5. A heat-sensitive transfer material as claimed in claim 1, wherein $R_2$ and $R_3$ together with the adjacent atom form a ring selected from the group consisting of the following formulae:

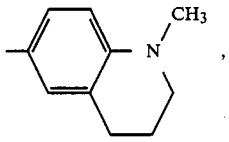

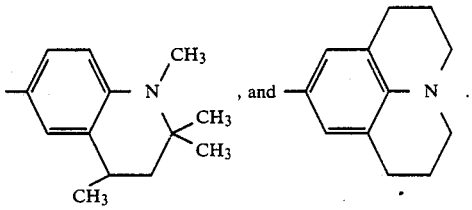

6. A heat-sensitive transfer material as claimed in claim 1, wherein $R_2$ and $R_4$ together with the adjacent atom form a ring selected from the group consisting of the following formulae:

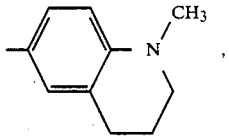

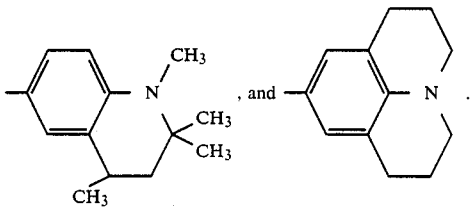

7. A heat-sensitive transfer material as claimed in claim 1, wherein at least two of X, Y and Z represent nitrogen atoms.

8. A heat-sensitive transfer material as claimed in claim 7, wherein X, Y and Z are the same and each represents a nitrogen atom.

9. A heat-sensitive transfer material as claimed in claim 1, wherein said binder is a resin.

10. A heat-sensitive transfer material as claimed in claim 9, wherein said binder resin is contained in said layer in an amount of from about 80 to 600 parts by weight per 100 parts by weight of said dye.

11. A heat-sensitive transfer material as claimed in claim 9, wherein the thickness of said heat-sensitive transfer layer is from about 0.2 to 5.0 μm.

12. A heat-sensitive transfer material as claimed in claim 1, wherein said binder is a wax.

13. A heat-sensitive transfer material as claimed in claim 12, wherein the ratio of said dye to said wax is about from 10 to 65 wt% of the total amount of said dye contained in said layer.

14. A heat-sensitive transfer material as claimed in claim 12, wherein the thickness of said heat-sensitive transfer layer is from about 1.5 to 6.0 μm.

* * * * *